US009268275B2

(12) United States Patent
Iwase

(10) Patent No.: US 9,268,275 B2
(45) Date of Patent: Feb. 23, 2016

(54) IMAGE FORMING APPARATUS WITH MECHANISM TO NARROW RECORDING MATERIAL FEEDING PATH

(71) Applicant: CANON KABUSHIKI KAISHA, Tokyo (JP)

(72) Inventor: Masaki Iwase, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/557,829

(22) Filed: Dec. 2, 2014

(65) Prior Publication Data

US 2015/0153693 A1 Jun. 4, 2015

(30) Foreign Application Priority Data

Dec. 2, 2013 (JP) ..... 2013-249348

(51) Int. Cl.
*G03G 15/20* (2006.01)

(52) U.S. Cl.
CPC ..... *G03G 15/2085* (2013.01)

(58) Field of Classification Search
CPC ..... G03G 15/2085
See application file for complete search history.

(56) References Cited

U.S. PATENT DOCUMENTS

| | | | |
|---|---|---|---|
| 6,754,458 | B2 | 6/2004 | Makihira |
| 6,950,618 | B2 | 9/2005 | Shimizu et al. |

FOREIGN PATENT DOCUMENTS

| | | | |
|---|---|---|---|
| JP | 09-230721 | A | 9/1997 |
| JP | 2002-323822 | A | 11/2002 |
| JP | 2004-157511 | A | 6/2004 |
| JP | 2004-361442 | A | 12/2004 |
| JP | 2006-182465 | A | 7/2006 |
| JP | 2010-282104 | A | 12/2010 |

*Primary Examiner* — G. M. Hyder
(74) *Attorney, Agent, or Firm* — Fitzpatrick, Cella, Harper & Scinto

(57) ABSTRACT

An image forming apparatus includes a fixing portion for fixing an image on a recording material while feeding the recording material carrying the image; a guiding member, provided downstream of the fixing portion with respect to a feeding direction of the recording material, for guiding the recording material; and an openable member for opening and closing a main assembly of the image forming apparatus, wherein the guiding member moves to narrow a feeding path of the recording material when the openable member is opened.

19 Claims, 4 Drawing Sheets

IMAGE FORMING APPARATUS WITH MECHANISM TO NARROW RECORDING MATERIAL FEEDING PATH

FIELD OF THE INVENTION AND RELATED ART

The present invention relates to in image forming apparatus such as a copying machine, a printer, etc., which is provided with a function to form an image on recording medium such as a sheet of recording paper.

Generally speaking, in an image forming operation carried out by an ordinary image forming apparatus, a toner image is formed on a sheet of recording medium delivered from a sheet storage portion of the apparatus. Then, the sheet on which the toner image has just been formed is heated in the fixing portion of the apparatus to fix the toner image to the sheet. After the formation of the toner image on the sheet, the sheet is conveyed to the sheet discharging portion of the apparatus. Then, it is discharged from the apparatus.

Some sheets of recording medium have burrs along their edges. Further, a sheet of recording medium sometimes substantially curls because it absorbs moisture from the ambient air. Therefore, it sometimes occurs that while a sheet of recording medium is conveyed from the sheet storage portion to the sheet discharge portion, the sheet hangs up in the sheet conveyance passage of the apparatus and is jammed, blocking thereby the sheet conveyance passage of the apparatus (paper jam).

One of the known methods for removing the jammed sheet in the sheet conveyance passage in the apparatus is to provide the main assembly of an image forming apparatus with multiple doors which allow an operator to access the jammed sheet to remove the jammed sheet (Japanese Laid-open Patent Application 2010-282104).

There is a concern, however, that if sheet jam occurs between the fixing portion and sheet discharging portion, the following problem might occur.

That is, it is possible that as the sheet conveyance passage is exposed by the opening of the sheet jam access door, a user (operator) who is trying to remove the jammed sheet of recording medium will come into contact with the portions of the fixing portion, which have become very high in temperature. Therefore, in order to prevent a user from accidentally coming into contact with hot portions of the fixing portion, it is desired to design an image forming apparatus to make as small as possible, the gap between the top and bottom components of the sheet conveyance passage, which are on the immediately downstream side of the fixing portion.

On the other hand, there is a concern that if the gap between the top and bottom components of the sheet conveyance passage is excessively small, the image bearing surface of a sheet of recording medium comes into contact with the top and/or bottom component of the sheet conveyance passage, and therefore causes the image to reduce in quality, while the sheet is conveyed from the fixing portion to the sheet discharging portion. There is also a concern that as the image bearing surface of a sheet of recording medium comes into contact with the sheet guiding components, the toner which has just been fixed adheres to the sheet guiding components.

For the reasons described above, it has been difficult to prevent a user from accidentally coming into contact with the hot portions of the fixing portion, while preventing the toner image on the sheet of recording medium from reducing in quality.

SUMMARY OF THE INVENTION

The prevent invention was made in consideration of the above described concerns. Thus, the primary object of the present invention is to provide an image forming apparatus which can prevent a user from accidentally coming into contact with the very hot portion of the fixing portion of the apparatus, while preventing the toner image on a sheet of recording medium from reducing in quality.

According to an aspect of the present invention, there is provided an image forming apparatus comprising a fixing portion for fixing an image on a recording material while feeding the recording material carrying the image; a guiding member, provided downstream of said fixing portion with respect to a feeding direction of the recording material, for guiding the recording material; and an openable member for opening and closing a main assembly of said image forming apparatus, wherein said guiding member moves to narrow a feeding path of the recording material when said openable member is opened.

According to another aspect of the present invention, there is provided an image forming apparatus comprising a fixing portion for fixing an image on a recording material while feeding the recording material carrying the image; a guiding member for guiding the recording material; and an openable member for opening and closing a main assembly of said image forming apparatus, said openable member being provided downstream of said guiding member with respect to the feeding direction of the recording material, wherein said guiding member moves to narrow a feeding path of the recording material when said openable member is opened.

According to a further aspect of the present invention, there is provided an image forming apparatus comprising a fixing portion for fixing an image on a recording material while feeding the recording material carrying the image; a guiding member, provided downstream of said fixing portion with respect to a feeding direction of the recording material, for guiding the recording material; and a manually operable member for manually moving said guiding member, wherein said guiding member moves so as to narrow a feeding path of the recording material when said manually operable member is operated.

Further features of the present invention will become apparent from the following description of exemplary embodiments with reference to the attached drawings.

DESCRIPTION OF THE PREFERRED EMBODIMENTS

Hereinafter, a couple of embodiments of the present invention are described in detail with reference to appended drawings. However, the measurement, material, and shape of the structural components, and also, the positional relationship among the structural components, are not intended to limit the present invention in scope. They are to be modified according to the structure of the apparatus to which the present invention is applied, and also, according to various conditions under which the apparatus is operated.

[Embodiment 1]

Figure 4:
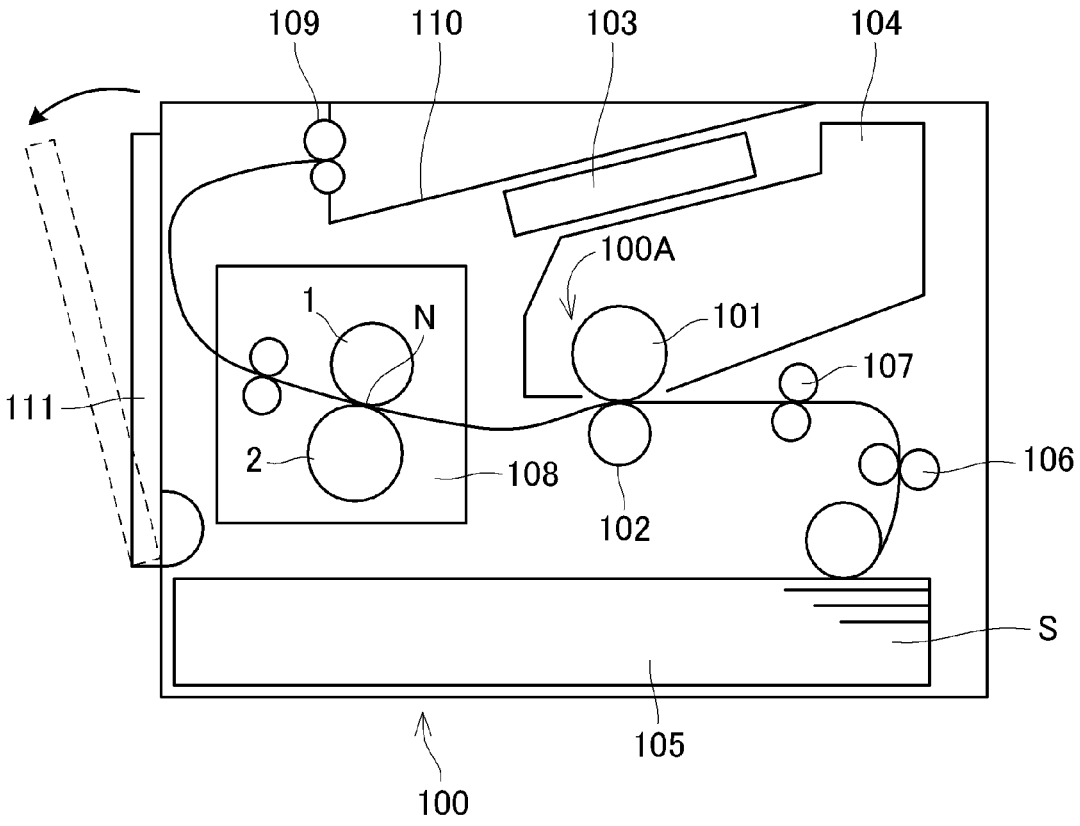
FIG. 4 is a sectional view of the image forming apparatus in the first and second embodiments of the present invention. It shows the general structure of the apparatus.

Here, the first embodiment of the present invention is described. FIG. 4 is a sectional view of the image forming apparatus, more concretely, a laser printer, in this embodiment. It shows the general structure of the printer.

The main assembly 100 (apparatus main assembly, hereafter) of the image forming apparatus in this embodiment is provided with an image forming section 100A for forming an image on a sheet S of recording medium with the use of an electrophotographic image forming method. This image forming section 100A is provided with a photosensitive drum 101 for forming a toner image (developer image), a transfer roller 102 for transferring the toner image formed on the photosensitive drum 101, onto the sheet S, etc.

As an image forming operation is started in the image forming section 100A structured as described above, a beam of laser light is projected upon the photosensitive drum 101 by a laser scanner 103 in response to image formation signals, whereby a latent image (electrostatic latent image) is formed on the photosensitive drum 101. Then, this latent image is developed with the use of toner (developer) stored in a toner cartridge 104. Consequently, a toner image (visible image) is formed on the photosensitive drum 101.

Meanwhile, a sheet S of recording medium is conveyed from a sheet storage cassette 105 in synchronism with the progression of the toner image forming operation. More concretely, the sheet S is conveyed by a pair of conveyance rollers 106 and a pair of registration rollers 107 to the transfer portion formed between the photosensitive drum 101 and transfer roller 102. In the transfer portion, bias is applied to the transfer roller 102. whereby the toner image on the photosensitive drum 101 is transferred onto the sheet S.

After the transfer of the toner image onto the sheet S, the sheet S is conveyed to a fixing device 108, in which heat and pressure are applied to the toner image on the sheet S. Thus, the toner image becomes fixed to the sheet S. Thereafter, the sheet S is discharged by a pair of discharge rollers 109, into a delivery portion 110, which is a part of the top wall of the apparatus main assembly 100.

Figure 1:
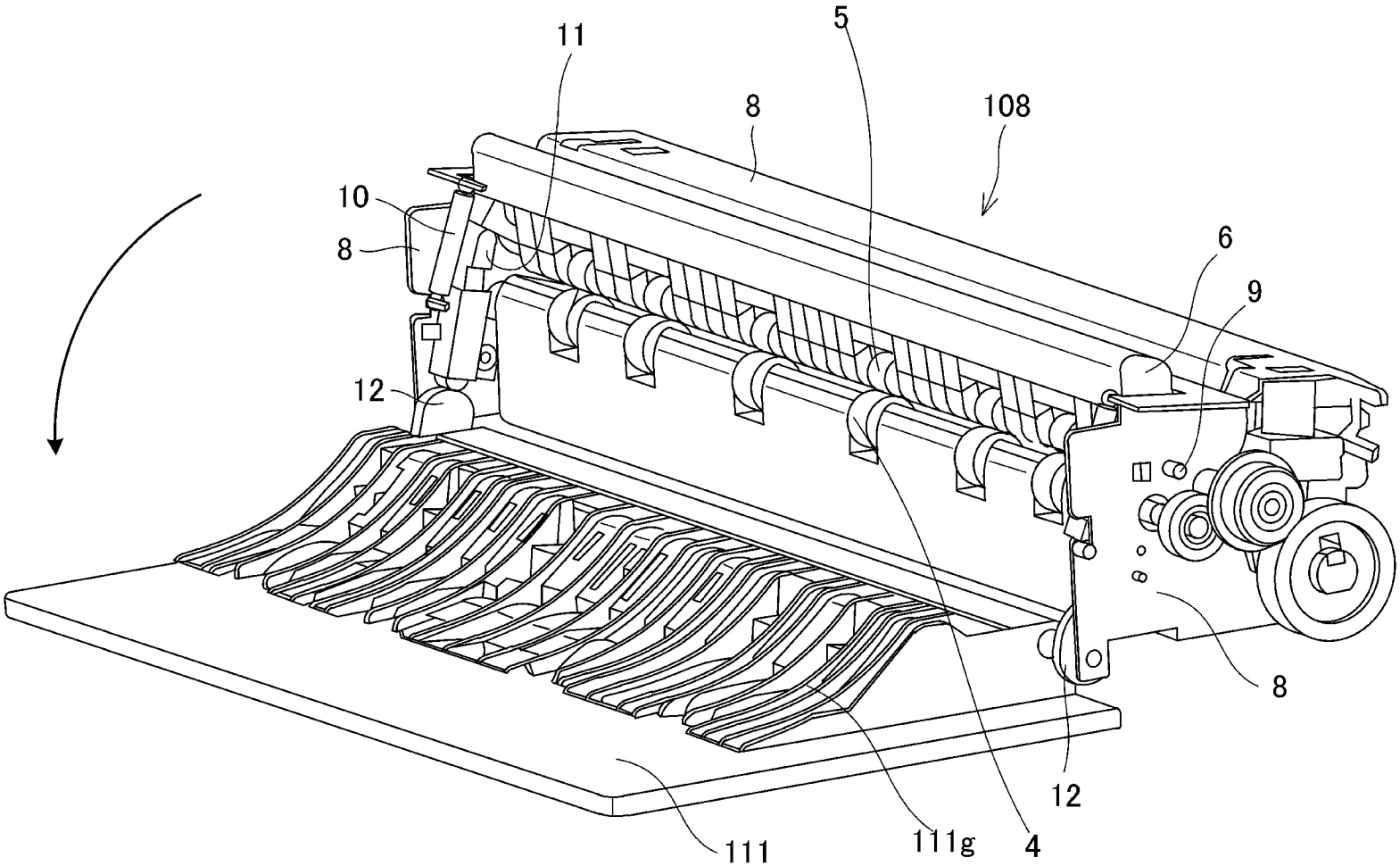
FIG. 1 is a perspective view of a combination of the fixing device and sheet jam access door of the image forming apparatus in the first embodiment of the present invention. It shows the general structure of the combination.

FIG. 1 is a perspective view of a combination of the fixing device (fixing portion) 108, and a sheet jam access door 111 (which can be opened or closed by user) of the image forming apparatus 1. It shows the general structure of the combination.

In this embodiment, the sheet jam access door 111 is attached to the apparatus main assembly 100, and can be manually opened or closed by a user. The door 111 is provided with sheet guiding portions (guiding ribs) 111*g* which guide a sheet S of recording medium to the pair of discharge rollers 109 after the sheet S comes out of the fixing device 108.

The image forming apparatus 1 is structured so that as the sheet jam access door 111 is opened, it becomes possible for a user to access a pair of sheet guiding members disposed on the downstream of the heating portion, in terms of the recording medium conveyance direction, in order to perform maintenance operations such as removing jammed sheets of recording medium.

Figure 2:
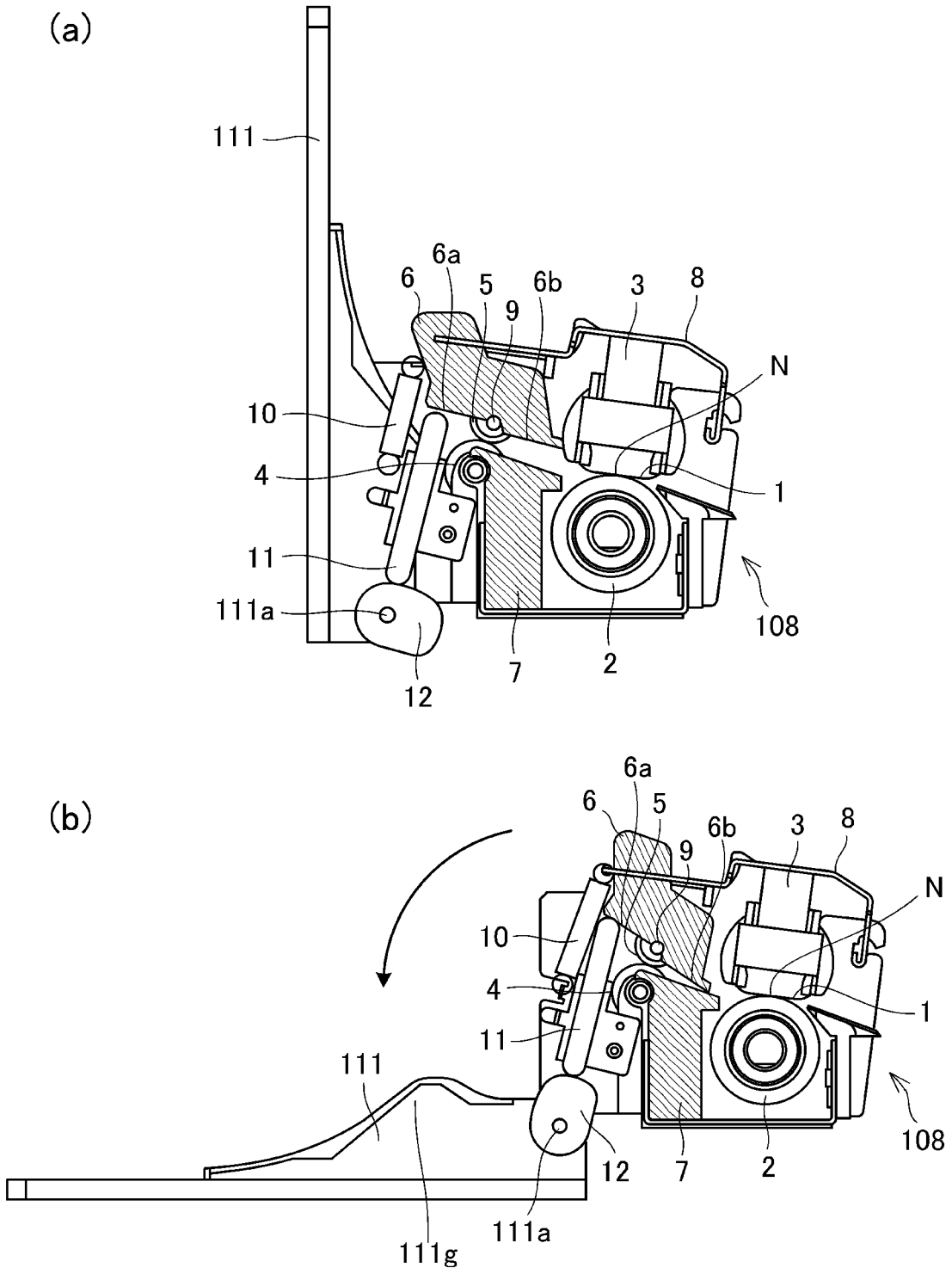
FIG. 2 comprises sectional views ((a) and (b)) of the combination of the fixing device and sheet jam access door of the image forming apparatus in the first embodiment of the present invention. It shows the general structure of the combination.

FIG. 2 comprises sectional views of the combination of the fixing device 108 and sheet jam access door 111. It shows the general structure of the combination. More specifically, in FIG. 2, (a) shows the state of the combination when the door 111 is closed, whereas in FIG. 2, (b) shows the state of the combination when the door 111 is open.

Referring to (a) of FIG. 2, a fixation film 1 and a pressure roller 2 form a fixation nip N (as heating portion) between them. The fixation film 1 is kept pressed upon the pressure roller 2 by the pressure generated by a compression spring 3 for fixation. The toner on a sheet S of recording medium is fixed to the sheet S by the application of heat and pressure to the sheet S, and the toner thereon, while conveying the sheet S through the fixation nip N, with the sheet S being pinched by the fixation film 1 and pressure roller 2.

There is disposed a pair of guiding members, more specifically, top and bottom guides 6 and 7, for guiding a sheet S of recording medium while the sheet S is conveyed, on the downstream of the fixation nip N in terms of the sheet conveyance direction. Here, the top and bottom guides may be referred to as one and other of the two guides, respectively.

The top and bottom guides 6 and 7 make up the portion of the sheet conveyance passage, which is on the downstream of the fixation nip N in terms of the sheet conveyance direction. This portion of the sheet conveyance passage is provided with a pair of rollers, more specifically, a pair of discharge rollers 4 and 5, which are for conveying a sheet S of recording medium toward the discharging portion 110 after the sheet S comes out of the fixation nip N. The discharge rollers 4 and 5 are located further downstream of the fixation nip N.

The top guide 6 is held by the frame 8 of the fixing device 108 in such a manner that it is pivotally movable about a pivot 9 which is coaxial with the rotational axis of the discharge roller 5. Further, when the image forming apparatus 1 is in a state in which it can output an image (sheet jam access door 111 is closed), the top guide 6 is kept in its sheet conveyance position by a pair of compression springs 10 as shown in (a) of FIG. 2. Regarding the sheet conveyance position of the top guide 6, the image forming apparatus main assembly 100 is structured so that even if the image bearing surface of a sheet S of recording medium comes into contact with the top guide 6 while the sheet S is conveyed between the pair of guiding members, the toner image on the sheet S does not reduce in quality. By the way, in this embodiment, the bottom guide 7 is fixed to the frame 8.

In this embodiment, a lever 11 is held to the frame 8 in such a manner that it is allowed to slide relative to the frame 8. More concretely, the lever 11 is disposed so that one end of the lever 11 remains in contact with the peripheral surface of a lift cam 12 (as camming member) with which the shaft (pivot) 111*a* of the sheet jam access door 111 is fitted, whereas the other end remains in contact with the top guide 6.

The lift cam 12 is fixed to the sheet jam access door 111. Thus, as the door 111 is opened or closed, the lift cam 12 is rotated with the pivot 111*a* of the door 111, by the pivotal movement of the door 111. By the way, the lift cam 12 is formed (molded) as an integral part of the door 111.

As the lift cam 12 is rotated by the pivotal movement of the sheet jam access door 111 in the opening direction, the lever 11 is moved upward (lifted) by the rotational movement of the lift cam 12. That is, the state of the combination of the fixing device 108 and door 111 changes from the state shown in (a) of FIG. 2 to the state shown in (b) of FIG. 2.

As the lever 11 moves upward, the other end of the lever 11 pushes up the downstream portion 6*a* of the top guide 6. Consequently, the top guide 6 pivotally moves. More specifically, the lever 11 pushes upward the downstream portion 6*a* of the top guide 6 against the resiliency of the springs 10. Here, the downstream portion 6*a* of the top guide 6 in terms of the sheet conveyance direction is such a portion of the top guide 6 that is on the downstream side of the pivot 9, which is coaxial with the discharge roller 5. By the way, hereafter, the portion of the top guide 6, which is on the upstream side of the pivot 9, is referred to as the upstream portion 6*b*.

Further, as the sheet jam access door 111 is closed, the lift cam 12 is rotated by the rotational movement of the door 111, being thereby made to cease to push up the lever 11, because the lift cam 12 is shaped so that the distance between its peripheral surface and rotational axis gradually reduces toward the point of the lift cam 12, by which the cam 12 remains in contact with the lever 11 when the door 111 remains closed.

As the lever 11 ceases to be pushed upward by the lift cam 12, the lever 11 does not push the top guide 6. Thus, the top guide 6 is pivotally moved by the resiliency of the pressure application springs 10 to the sheet conveyance position, shown in (b) of FIG. 2, in which it remains during an image forming operation.

As described above, in this embodiment, the image forming apparatus main assembly 100 is structured so that as the sheet jam access door 111 is opened or closed, the lever 11 is moved up and down, respectively, by the movement of the door 111, whereby the top guide 6 is pivotally moved by the upward and downward movement of the lever 11, as shown in (a) and (b) of FIG. 2, respectively.

Next, what occurs as the sheet jam access door 111 is opened to remove a jammed sheet (sheets) is described in detail. In a case where sheet jam occurred in the adjacencies of the fixing device 108, a user is to open the sheet jam access door 111. As the door 111 is opened, the lift cam 12 is made to move the lever 11 upward by the opening movement of the door 111, whereby the downstream portion 6*b* of the top guide 6 is moved upward from its sheet conveyance position, shown in (a) of FIG. 2, in which it remains while an image is formed. With this movement of the downstream portion 6*b* of the top guide 6, the top guide pivotally moved about the pivot 9, causing therefore the upstream portion 6*b* of the top guide 6 to move from its sheet conveyance position, shown in (a) of FIG. 2, in which it remains while an image is formed, toward the bottom guide 7.

Consequently, the gap between the upstream portion 6*b* of the top guide 6, and the bottom guide 7 becomes smaller (narrower), as shown in (b) of FIG. 2, than when the top guide 6 remains in the position, shown in (a) of FIG. 2, while an image is formed. During this pivotal movement of the top guide 6, the gap between the downstream portion 6*a* of the top guide 6, and the bottom guide 7, becomes larger (wider), as shown in (b) FIG. 2, than when the top guide 6 is in the position, shown in (a) of FIG. 2, while an image is formed.

As the sheet jam access door 111 is closed, the lift cam 12 is rotated by the closing movement of the sheet jam access door 111, allowing thereby the downstream portion 6*a* of the top guide 6, and the lever 11, to be pushed down by the resiliency of the pressure application springs 10. Consequently, the top guide 6 returns to the sheet conveyance position, shown in (a) of FIG. 2, in which it remains while an image is formed.

As described above, in the case of the image forming apparatus main assembly 100 in this embodiment, as the sheet jam access door 111 is opened, it becomes possible for a user to access the top and bottom guides 6 and 7 from the downstream side in terms of the sheet conveyance direction to remove the jammed sheet in the adjacencies of the fixing device 108.

Further, the image forming apparatus 100A is structured so that as the sheet jam access door 111 is opened, the gap between the upstream portion 6*b* of the top guide 6 and the bottom guide 7 becomes smaller (exit side of sheet conveyance passage formed by pair of guiding members is narrowed) than when an image is being formed.

Therefore, it is possible to prevent a user from accidentally coming into contact with very hot portions of the apparatus. That is, it is possible to improve an image forming apparatus in terms of the safety in maintenance. Here, very hot portions mean the portions of the fixing device 108, in particular, the portions in the fixation nip N and its adjacencies, which have become very high in temperature.

Further, as the sheet jam access door 111 is opened, the gap between the downstream portion 6*a* of the top guide 6, and the bottom guide 7, becomes greater than when an image is being formed. Therefore, it becomes easier for a user to access between the top and bottom guides 6 and 7 if sheet jam occurs between the top and bottom guides 6 and 7. That is, it is possible to improve an image forming apparatus in terms of efficiency with which a jammed sheet can be removed from between the top and bottom guides 6 and 7. By the way, even after the movement of the top guide 6 into the position shown in (b) of FIG. 2, there remains a sufficient amount of space between the upstream portion 6*b* of the top guide 6, and the bottom guide 7 for the jammed sheet to be smoothly pulled out.

The gap between the top and bottom guides 6 and 7 when the top guide 6 is in the sheet conveyance position, in which it remains when an image is being formed, is set so that even if the image bearing surface of a sheet S of recording medium happens to come into contact with the top guide 6 while the sheet S is conveyed, the toner image on the sheet P is not reduced in quality. Therefore, even if the image bearing surface of the sheet S comes into contact with the top guide when an image is being formed, not only is it possible to prevent the toner image from reducing in quality, but also to prevent the toner on the sheet S from adhering to the top guide 6.

Thus, according to this embodiment, it is possible to prevent a user from accidentally coming into contact with very hot portions of the image forming apparatus main assembly 100 during a maintenance operation, and also, to prevent the toner image on the sheet S from reducing in quality. Moreover, according to this embodiment, it is unnecessary to provide an image forming apparatus main assembly 100 with additional structural components such as a shutter. Therefore, it is unnecessary to increase the image forming apparatus main assembly 100 in size, and also, it is possible to minimize the cost increase related to sheet jam access.

In this embodiment, as the sheet jam access door 111 is opened, the gap between the upstream portion 6b of the top guide 6and the bottom guide 7 is made smaller by the opening movement of the door 111 than when an image is being formed. However, this embodiment is not intended to limit the present invention in scope. For example, an image forming apparatus may be provided with a lever or the like component which can be manipulated by a user after the door 111 is opened, and is structured so that as the lever or the like component is changed in position (by the user), the gap between the pair of guides is made smaller by the movement of the lever or the like than when an image is being formed.

Also in this embodiment, it is the top guide 6 of the pair of guides that is rotationally moved to reduce the gap between the pair of guides compared to that when an image is being formed. However, this embodiment is not intended to limit the present invention is scope. That is, all that is required is that an image forming apparatus main assembly is structured so that at least one of the pair of sheet guides is rotationally movable.

Further, in this embodiment, as the sheet jam access door 111 is opened, the gap between the upstream portion 6*b* of the top guide 6, and the bottom guide 7 becomes smaller than when an image is being formed. However, this embodiment is not intended to limit the present invention in scope. That is, an image forming apparatus main assembly 100 may be structured so that as the sheet jam access door 111 is opened, the gap between the top and bottom guides 6 and 7 is evenly reduced by the opening movement of the door 111 compared to that when an image is being formed. In such a case, the top guide 6 is held to the frame 8 in such a manner that the downstream portion of the top guide 6 in terms of the sheet conveyance direction is pivotally movable about the pivot 9 which coincides with the rotational axis of the discharge roller 5 of the fixing device 108.

Moreover, in this embodiment, the top guide 6 is kept pressed by the force generated by the pressure generation springs 10, toward the sheet conveyance position in which the top guide 6 remains when an image is being formed. However, this embodiment is not intended to limit the present invention in scope. For example, an image forming apparatus main assembly 100 may be structured so that as the sheet jam access door 111 is closed, the top guide 6 is made to return to the sheet conveyance position, by its own weight.

[Embodiment 2]

Next, the second embodiment of the present invention is described.

In the first embodiment, the top guide 6 is held to the frame 8 so that it can be pivotally moved about the pivot 9. In comparison, in this embodiment, the bottom guide 7 is held to the frame 8 so that it is vertically slidable along the frame 8. As for the top guide 6, it is fixed to the frame 8. The second embodiment is described with regard to only the structural features of the image forming apparatus main assembly 100 in this embodiment, which are different from the counterparts in the first embodiment. That is, the structural features of the image forming apparatus main assembly 100 in this embodiment, which are the same as the counterparts in the first embodiment, are not described.

Figure 3:
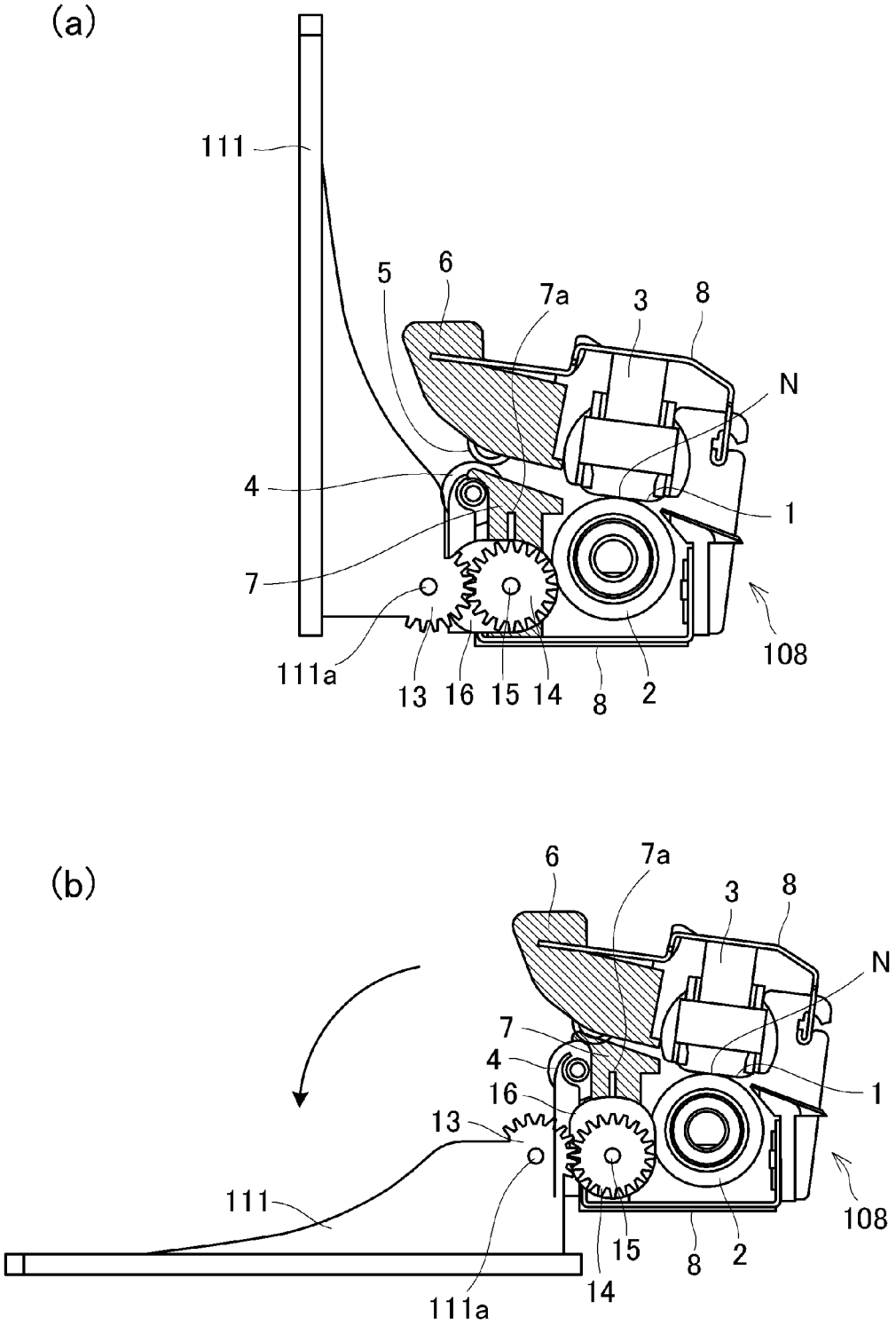
FIG. 3 comprises sectional views ((a) and (b)) of a combination of the fixing device and sheet jam access door of the image forming apparatus in the second embodiment of the present invention. It shows the general structure of the combination.

FIG. 3 comprises sectional views ((a) and (b)) of the combination of the fixing device 108 and sheet jam access door 111 in this embodiment. It shows the general structure of the combination. In FIG. 3, (a) shows the state of the combination when the door 111 is closed, whereas (b) of FIG. 3 shows the state of the combination when the door 111 is open.

Referring to FIG. 3, the sheet jam access door 111 in this embodiment is provided with a gear 13, which is coaxial with the axle 111*a* of the door 111. In this embodiment, the gear 13 is an integral part of the door 111 (molded as part of door 111). However, this embodiment is not intended to limit the present invention in scope. For example, the gear 13 may be separately molded from the door 111, and then, attached to the door 111.

The gear 13 is meshed with a gear 14, which is rotatably held to the frame 8.

The gear 14 is an integral part of a bottom lift cam 16 (caroming member). It is rotatably supported by an axle 15 crimped to the fixing device frame 8. The gear 13, gear 14, and bottom guide lift cam 16 make up a mechanical power transmission train. In this embodiment, the gear 14 is an integral part of the bottom guide lift cam 16. However, this set up is not mandatory. For example, the gear 14 may be separately formed from the bottom guide lift cam 16, fixed to the cam 16, and rotatably supported by the shaft 15.

Referring to (b) of FIG. 3, as the sheet jam access door 111 is opened, the gear 13 is rotated, whereby the gear 14, which is in mesh with the gear 13, rotates with the lift cam 16.

As the lift cam 16 rotates, a rib 7*a* with which the bottom guide 7 is provided, is pushed up by the peripheral surface of the lift cam 16. Thus, the bottom guide 7 is moved upward. Consequently, the gap between the top and bottom guides 6 and 7 becomes smaller than when an image is being formed.

That is, the same effects as those obtainable by the structural arrangement in the first embodiment can also be obtained by the structural arrangement in this embodiment.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims priority from Japanese Patent Application No. 249348/2013 filed Dec. 2, 2013, which is hereby incorporated by reference.

What is claimed is:

1. An image forming apparatus comprising:

a fixing portion for fixing an image on a recording material while feeding the recording material carrying the image;

a guiding member, provided downstream of said fixing portion with respect to a feeding direction of the recording material, for guiding the recording material; and an openable member for opening and closing a main assembly of said image forming apparatus, wherein said guiding member moves to narrow a feeding path of the recording material when said openable member is opened.

2. An apparatus according to claim 1, wherein said openable member is disposed downstream of said guiding member with respect to the feeding direction.

3. An apparatus according to claim 2, wherein said openable member is provided with a guide portion for guiding the recording material.

4. An apparatus according to claim 3, wherein said openable member is provided with a cam portion for moving said guiding member.

5. An apparatus according to claim 1, wherein said guiding member guides such a surface of the recording material which has carried an unfixed image before the recording material passes through said fixing portion.

6. An apparatus according to claim 1, wherein said guiding member guides such a surface of the recording material opposite to a surface which has carried an unfixed image before the recording material passes through said fixing portion.

7. An apparatus according to claim 1, wherein said guiding member moves such that an upstream portion of said guiding member with respect to the feeding direction is narrowed, and a downstream portion of said guiding member with respect to the feeding direction is widened.

8. An image forming apparatus comprising:

a fixing portion for fixing an image on a recording material while feeding the recording material carrying the image;

a guiding member for guiding the recording material;

an openable member for opening and closing a main assembly of said image forming apparatus, said openable member being provided downstream of said guiding member with respect to the feeding direction of the recording material, wherein said guiding member moves to narrow a feeding path of the recording material when said openable member is opened.

9. An apparatus according to claim 8, wherein said openable member is provided with a guide portion for guiding the recording material.

10. An apparatus according to claim 9, wherein said openable member is provided with a cam portion for moving said guiding member.

11. An apparatus according to claim 8, wherein said guiding member moves such that an upstream portion of said guiding member with respect to the feeding direction is narrowed, and a downstream portion of said guiding member with respect to the feeding direction is widened.

12. An image forming apparatus comprising:

a fixing portion for fixing an image on a recording material while feeding the recording material carrying the image;

a guiding member, provided downstream of said fixing portion with respect to a feeding direction of the recording material, for guiding the recording material; and a manually operable member for manually moving said guiding member, wherein said guiding member moves so as to narrow a feeding path of the recording material when said manually operable member is operated.

13. An apparatus according to claim 12, wherein said guiding member guides such a surface of the recording material which has carried an unfixed image before the recording material passes through said fixing portion.

14. An apparatus according to claim 12, wherein said guiding member guides such a surface of the recording material opposite to a surface which has carried an unfixed image before the recording material passes through said fixing portion.

15. An apparatus according to claim 12, wherein said guiding member moves such that an upstream portion of said guiding member with respect to the feeding direction is narrowed, and a downstream portion of said guiding member with respect to the feeding direction is widened.

16. An apparatus according to Claim 12, wherein said manually operable member is an openable member for opening and closing a main assembly of said image forming apparatus.

17. An apparatus according to claim 16, wherein said openable member is disposed downstream of said guiding member with respect to the feeding direction.

18. An apparatus according to claim 17, wherein said openable member is provided with a guide portion for guiding the recording material.

19. An apparatus according to claim 18, wherein said openable member is provided with a cam portion for moving said guiding member.

* * * * *